US008023872B2

(12) United States Patent
Tao et al.

(10) Patent No.: US 8,023,872 B2
(45) Date of Patent: Sep. 20, 2011

(54) BELT DEVICE AND IMAGE FORMING APPARATUS

(75) Inventors: Satoru Tao, Ibaraki (JP); Makoto Nakura, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 745 days.

(21) Appl. No.: 12/104,127

(22) Filed: Apr. 16, 2008

(65) Prior Publication Data

US 2008/0267673 A1 Oct. 30, 2008

(30) Foreign Application Priority Data

Apr. 27, 2007 (JP) ..... 2007-117841

(51) Int. Cl.
*G03G 15/01* (2006.01)

(52) U.S. Cl. ..... 399/302; 399/308; 198/810.03

(58) Field of Classification Search ..... 399/302
See application file for complete search history.

(56) References Cited

U.S. PATENT DOCUMENTS

| | | | | |
|---|---|---|---|---|
| 5,027,160 | A | 6/1991 | Okada et al. | |
| 5,903,805 | A | 5/1999 | Ueda et al. | |
| 5,964,339 | A * | 10/1999 | Matsuura et al. | 198/810.03 |
| 2003/0038955 | A1 | 2/2003 | Yamada et al. | |
| 2006/0289280 | A1 | 12/2006 | Furuya et al. | |
| 2007/0144871 | A1 | 6/2007 | Tao et al. | |
| 2008/0019736 | A1 | 1/2008 | Ryo et al. | |
| 2008/0056778 | A1 | 3/2008 | Tao et al. | |

FOREIGN PATENT DOCUMENTS

| | | |
|---|---|---|
| JP | 5-301651 | 11/1993 |
| JP | 2000-233843 | 8/2000 |
| JP | 2001-83840 | 3/2001 |
| JP | 2001-130779 A | 5/2001 |
| JP | 2002-287527 | 10/2002 |
| JP | 3473148 | 9/2003 |
| JP | 2004-78082 | 3/2004 |
| JP | 3633294 | 1/2005 |
| JP | 2005-338522 | 12/2005 |
| JP | 3755356 | 1/2006 |
| JP | 3791366 | 4/2006 |
| JP | 2006-178309 A | 7/2006 |
| JP | 2006-343629 | 12/2006 |
| JP | 3931467 | 3/2007 |
| JP | 2007-178938 | 7/2007 |

* cited by examiner

*Primary Examiner* — David Gray
*Assistant Examiner* — Roy Y Yi
(74) *Attorney, Agent, or Firm* — Oblon, Spivak, McClelland, Maier & Neustadt, L.L.P.

(57) ABSTRACT

In a belt device, a first detecting unit detects a widthwise displacement of a belt, and a correcting unit corrects displacement of the belt in the width direction during a period starting from turning power on and ending with completion of drive preparation of the belt based on the widthwise displacement. Moreover, a second detecting unit detects whether the belt has displaced in the width direction by an amount that is greater than a threshold, and a belt stopping unit stops running of the belt when the second detecting unit detects that the belt has displaced by an amount that is greater than the threshold.

19 Claims, 7 Drawing Sheets

BELT DEVICE AND IMAGE FORMING APPARATUS

CROSS-REFERENCE TO RELATED APPLICATIONS

The present application claims priority to and incorporates by reference the entire contents of Japanese priority document, 2007-117841 filed in Japan on Apr. 27, 2007.

BACKGROUND OF THE INVENTION

1. Field of the Invention

The present invention relates to a belt device for use in an image forming apparatus.

2. Description of the Related Art

Conventionally, in the image forming apparatus such as the copying machine and the printer, a tandem color image forming apparatus including the intermediate transfer belt (belt device) has been known (for example, see Japanese Patent Application Laid-open No. 2006-343629, Japanese Patent Application Laid-open No. 2001-83840, and Japanese Patent No. 3755356).

More specifically, four photosensitive drums (image carriers) are arranged in proximity in a row arrangement, facing the intermediate transfer belt (belt device). With these four photosensitive drums, black, yellow, magenta, and cyan toner images are respectively formed. Respective color toner images formed by the respective photosensitive drums are superposed and transferred on the intermediate transfer belt. A plurality of color toner images carried on the intermediate transfer belt are transferred onto a recording medium as a color image.

In the above type of image forming apparatus, such a technique has been known that a widthwise displacement of the intermediate transfer belt is detected to correct the widthwise displacement of the intermediate transfer belt based on the detection result (for example, see Japanese Patent Application Laid-open No. 2006-343629, Japanese Patent Application Laid-open No. 2001-83840, and Japanese Patent No. 3755356). It is an object of such a technique to suppress problems that the quality of the color image degrades due to meandering of the intermediate transfer belt and that after the intermediate transfer belt is displaced largely in a width direction (misalignment of the belt), the intermediate transfer belt comes in contact with another member to damage the intermediate transfer belt.

Specifically, in Japanese Patent Application Laid-open No. 2006-343629, a first detector (displacement sensor) detects a displacement magnitude of a contact that abuts against an end in the width direction of the intermediate transfer belt (endless belt) and swings by following the displacement. A correcting unit (meandering correcting roller) corrects the displacement (meandering) of the intermediate transfer belt based on the detection result of the first detector. When the intermediate transfer belt meanders exceeding a detection range (boundary of malfunction detection) of the first detector, it is determined that the apparatus has malfunction and drive of the intermediate transfer belt is stopped.

Further, in Japanese Patent Application Laid-open No. 2006-343629, a second detector (edge sensor) is arranged at a position away from the first detector (displacement sensor) widthwise outward. When the second detector detects an edge of the intermediate transfer belt, it is also determined that the intermediate transfer belt meanders further largely due to malfunction of the apparatus, and the drive of the intermediate transfer belt is stopped.

Meanwhile, Japanese Patent No. 3755356 discloses a technique of an image forming apparatus that corrects the displacement (meandering) of the intermediate transfer belt by using a correcting unit (steering roller) based on a detection result of a first detector (edge sensor), where malfunction detection by the first detector (edge sensor) is not performed for a predetermined time from turning the power of the apparatus on. This technique is for preventing a problem that immediately after replacement of the intermediate transfer belt, meandering of the intermediate transfer belt is mistakenly detected as malfunction, although the intermediate transfer belt is normally driven.

In the technique disclosed in Japanese Patent Application Laid-open No. 2006-343629, immediately after replacement of the intermediate transfer belt, meandering of the intermediate transfer belt can be mistakenly detected as malfunction, although the intermediate transfer belt is normally driven.

More specifically, the replaced belt member can be assembled widthwise deviated from a target position, depending on the skill level of the operator. In such a case, if there is originally no malfunction in the belt device, the correcting unit will correct the position of the belt member to the target position at the time of initialization after turning the power on. However, it is determined that the belt member meanders exceeding the detection range of the first detector due to malfunction of the apparatus, and the drive of the intermediate transfer belt is stopped. Accordingly, the image forming apparatus is uselessly shut down, or a useless maintenance operation is performed.

On the other hand, in the technique disclosed in Japanese Patent No. 3755356, because malfunction detection by the first detector is not performed for a predetermined time from turning the power of the apparatus on, there can be expected an effect of suppressing a problem that meandering of the intermediate transfer belt is mistakenly detected immediately after replacement of the intermediate transfer belt, although the intermediate transfer belt is normally driven.

However, in the technique disclosed in Japanese Patent No. 3755356, a second detector that detects large meandering of the belt member is not provided separately from the first detector. Therefore, if the belt device essentially has malfunction, not due to the assembly accuracy of the belt member, the malfunction cannot be detected, and thus, there is a high possibility that a newly replaced belt member can be damaged.

Such a problem cannot be ignored, particularly, in a high-speed machine in which the belt member is driven at a high speed (an image forming apparatus with greater process linear velocity).

This problem is not limited to the belt device using the intermediate transfer belt as the belt member. In other words, this is a common problem in belt devices that detect and correct displacement of the belt member, such as a belt device using the transfer carrier belt as the belt member and a belt device using the photosensitive belt as the belt member.

SUMMARY OF THE INVENTION

It is an object of the present invention to at least partially solve the problems in the conventional technology.

According to an aspect of the present invention, there is provided a belt device for use in an image forming apparatus includes an endless belt member that runs in a predetermined direction; a first detecting unit that detects a widthwise displacement of the belt member indicative of an amount of displacement in a width direction of the belt member; a correcting unit that corrects displacement of the belt member in the width direction during a period starting from turning power on and ending with completion of drive preparation of the belt member based on the widthwise displacement; a second detecting unit that detects whether the belt member has displaced in the width direction by an amount that is greater than a threshold; and a belt stopping unit that stops running of the belt member when the second detecting unit detects that the belt member has displaced by an amount that is greater than the threshold.

According to another aspect of the present invention, there is provided an image forming apparatus that includes the above belt device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
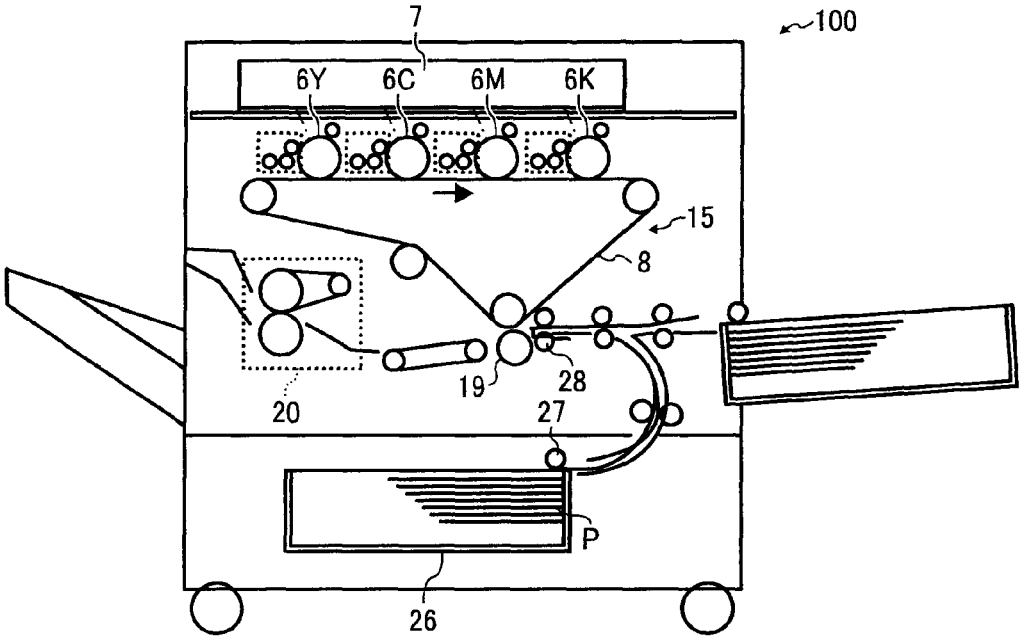
FIG. 1 is a schematic side view of an image forming apparatus according to an embodiment of the present invention.

Exemplary embodiments of the present invention will be explained below in detail with reference to the accompanying drawings. In the drawings, like parts are denoted by like reference numerals, and explanations thereof will be appropriately simplified or omitted.

Figure 2:
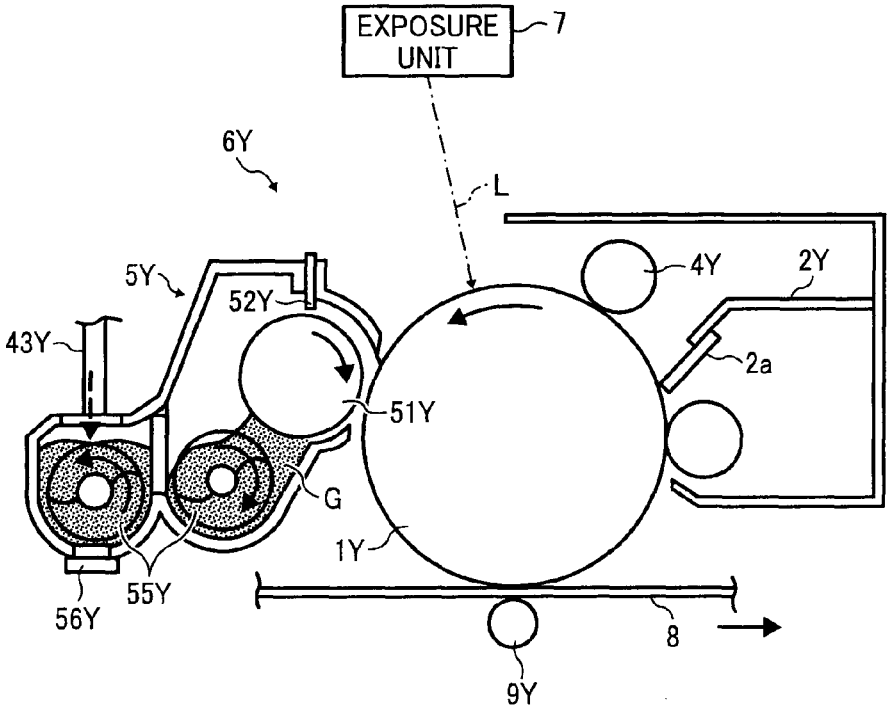
FIG. 2 is an enlarged side view of an imaging unit for yellow shown in FIG. 1.

A configuration and an operation of an entire image forming apparatus are explained first with reference to FIGS. 1 and 2.

FIG. 1 is a schematic side view of a printer as an image forming apparatus according to an embodiment of the present invention, and FIG. 2 is an enlarged side view of an imaging unit for yellow shown in FIG. 1.

As shown in FIG. 1, an intermediate transfer-belt device 15 as a belt device is installed at a center of an image forming apparatus 100 (hereinafter, also "apparatus main unit 100"). Imaging units 6Y, 6M, 6C, and 6K are provided in proximity in a row arrangement corresponding to respective colors (yellow, magenta, cyan, and black), facing an intermediate transfer belt 8 (belt member) of the intermediate transfer-belt device 15.

With reference to FIG. 2, the imaging unit 6Y corresponding to yellow includes a photosensitive drum 1Y as an image carrier, a charger 4Y arranged around the photosensitive drum 1Y, a developing unit 5Y, a cleaning unit 2Y, and a discharger (not shown). An imaging process (charging process, exposure process, development process, transfer process, and cleaning process) is performed on the photosensitive drum 1Y to form a yellow image on the photosensitive drum 1Y.

Other three imaging units 6M, 6C, and 6K have substantially the same configuration as that of the imaging unit 6Y corresponding to yellow, except that the color of a used toner is different, thereby forming an image corresponding to each toner color. Explanations of the three imaging units 6M, 6C, and 6K will be appropriately omitted, and only the imaging unit 6Y corresponding to yellow is explained below.

With reference to FIG. 2, the photosensitive drum 1Y is rotated counterclockwise in FIG. 2 by a drive motor (not shown). The surface of the photosensitive drum 1Y is uniformly charged at the position of the charger 4Y (the charging process).

The surface of the photosensitive drum 1Y then reaches an irradiation position of laser beams L emitted from an exposure unit 7, and an electrostatic latent image corresponding to yellow is formed by exposure scanning at this position (the exposure process).

The surface of the photosensitive drum 1Y then reaches an opposed position to the developing unit 5Y, where the electrostatic latent image is developed to form a yellow toner image (the development process).

The surface of the photosensitive drum 1Y then reaches an opposed position to the intermediate transfer belt 8 (belt member) and a transfer roller 9Y (primary transfer roller), where the toner image on the photosensitive drum 1Y is transferred onto the intermediate transfer belt 8 (primary transfer process). At this time, untransferred toner slightly remains on the photosensitive drum 1Y.

Subsequently, the surface of the photosensitive drum 1Y reaches an opposed position to the cleaning unit 2Y, where the untransferred toner remaining on the photosensitive drum 1Y is collected in the cleaning unit 2Y by a cleaning blade 2*a* (the cleaning process).

Finally, the surface of the photosensitive drum 1Y reaches an opposed position to the discharger (not shown), where a residual potential on the photosensitive drum 1Y is removed.

A series of imaging process performed on the photosensitive drum 1Y is completed in this manner.

The imaging process described above is performed likewise in the other imaging units 6M, 6C, and 6K as in the yellow imaging unit 6Y. That is, the laser beams L based on image information are irradiated from the exposure unit 7 arranged above the imaging unit toward the photosensitive drums 1M, 1C, and 1K in the respective imaging units 6M, 6C, and 6K. Specifically, the exposure unit 7 emits the laser beams L from a light source to irradiate the laser beams L to the photosensitive drums via a plurality of optical elements, while scanning the laser beams L by a rotated polygon mirror.

The toner image of the respective colors formed on the respective photosensitive drums via the development process is superposed and transferred on the intermediate transfer belt 8. The color image is thus formed on the intermediate transfer belt 8.

Figure 3:
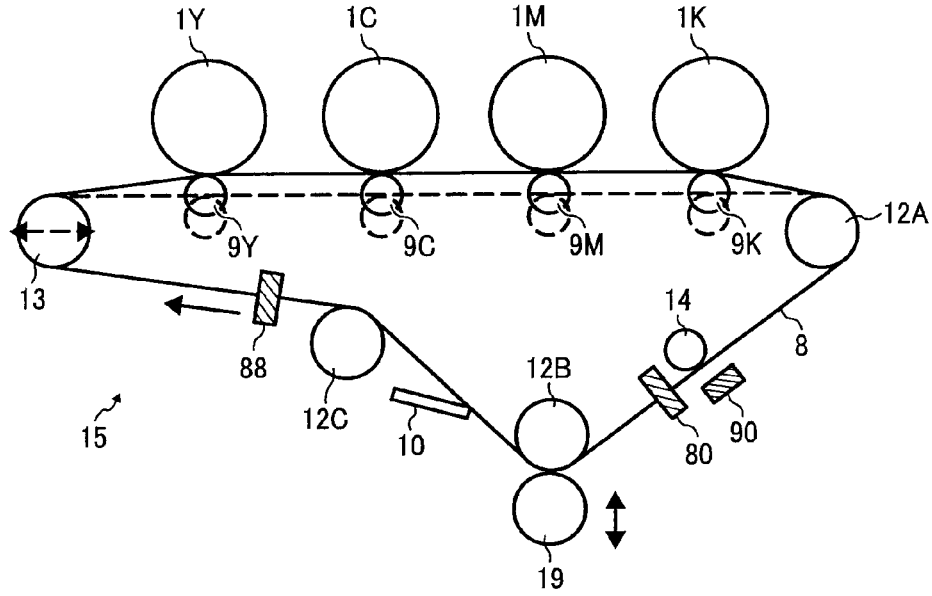
FIG. 3 is a detailed schematic side view of a belt device shown in FIG. 1.

With reference to FIG. 3, the intermediate transfer-belt device 15 (belt device) includes the intermediate transfer belt 8, four transfer rollers 9Y, 9M, 9C, and 9K, a drive roller 12A, tension rollers 12B and 12C, a correcting roller 13 (correcting unit), a regulating roller 14, a first detector 80 (first detecting unit), a second detector 88 (second detecting unit), a photosensor 90, and an intermediate-transfer cleaning unit 10. The intermediate transfer belt 8 is laid across in a tensioned condition and supported by a plurality of roller members 12A to 12C, 13, and 14, and is endlessly moved in an arrow direction in FIG. 3 due to rotation of one roller member (drive roller) 12A.

The intermediate transfer belt 8 is put between the four transfer rollers 9Y, 9M, 9C, and 9K (primary transfer rollers) and the photosensitive drums 1Y, 1M, 1C, and 1K to form a primary transfer nip. High voltage (transfer bias) of an inverse polarity to that of the toner is applied to the transfer rollers 9Y, 9M, 9C, and 9K.

The intermediate transfer belt 8 is driven in an arrow direction to pass the primary transfer nip of the transfer rollers 9Y, 9M, 9C, and 9K sequentially. Accordingly, the toner image of the respective colors on the photosensitive drums 1Y, 1M, 1C, and 1K are superposed and primarily transferred on the intermediate transfer belt 8.

The intermediate transfer belt 8 carrying the toner image of the respective colors superposed and transferred reaches the opposed position to a secondary transfer roller 19. At this position, the intermediate transfer belt 8 is put between the tension roller 12B and the secondary transfer roller 19 to form a secondary transfer nip. High voltage (secondary transfer bias) of an inverse polarity to that of the toner is applied to the secondary transfer roller 19. Accordingly, the toner images of the four colors formed on the intermediate transfer belt 8 are transferred to a recording medium P such as a transfer sheet carried to the position of the secondary transfer nip (secondary transfer process). At this time, the untransferred toner that has not been transferred to the recording medium P remains on the intermediate transfer belt 8.

The intermediate transfer belt 8 then reaches the position of the intermediate-transfer cleaning unit 10. At this position, the untransferred toner on the intermediate transfer belt 8 is removed.

A series of the transfer process performed on the intermediate transfer belt 8 is completed in this manner. The configuration and the operation of the intermediate transfer-belt device 15 as the belt device will be explained later in detail with reference to FIGS. 3 to 10.

With reference to FIG. 1, the recording medium P carried to the position of the secondary transfer nip has been carried from a paper feeder 26 arranged below the apparatus main unit 100 (or a paper feeder arranged on the side of the apparatus) via a paper feed roller 27, a registration roller pair 28, and the like.

Specifically, a plurality of recording media P such as the transfer sheets are stacked and stored in the paper feeder 26. When the paper feed roller 27 is rotated counterclockwise in FIG. 1, the uppermost recording medium P is fed toward between the rollers of the registration roller pair 28.

The recording medium P carried to the registration roller pair 28 temporarily stops at the position of a roller nip of the registration roller pair 28, whose rotation has been stopped. The registration roller pair 28 is then rotated with timing adjusted with the color image on the intermediate transfer belt 8, and the recording medium P is carried toward the secondary transfer nip. Accordingly, a desired color image is transferred onto the recording medium P.

The recording medium P to which the color image has been transferred at the position of the secondary transfer nip is carried to a position of a fuser 20. At this position, the color image transferred onto the surface of the recording medium P is fixed on the recording medium P due to heat and pressure by a fuser roller and a pressure roller.

The recording medium P is then ejected outside of the apparatus by a paper-ejection roller pair (not shown). The recording medium P ejected outside of the apparatus by the paper-ejection roller pair is sequentially stacked on a stack unit as an output image.

A series of the image forming process in the image forming apparatus is thus completed.

The configuration and the operation of the developing unit in the imaging unit are explained next in detail with reference to FIG. 2.

The developing unit 5Y includes a developing roller 51Y opposed to the photosensitive drum 1Y, a doctor blade 52Y opposed to the developing roller 51Y, two carrier screws 55Y arranged in a developer storage unit, a toner supply route 43Y that communicates with the developer storage unit via an opening, and a density detection sensor 56Y that detects toner density of a developer. The developing roller 51Y includes a magnet set therein and a sleeve that rotates around the magnet. A two-component developer containing a carrier and a toner is stored in the developer storage unit.

The developing unit 5Y formed in this manner operates in a following manner.

The sleeve of the developing roller 51Y rotates in the arrow direction in FIG. 2. The developer carried on the developing roller 51Y by a magnetic field generated by the magnet moves on the developing roller 51Y with the rotation of the sleeve. The developer in the developing unit 5Y is adjusted so that a percentage of the toner (toner density) in the developer is within a predetermined range.

Subsequently, the toner supplied to the developer storage unit circulates in the two completely isolated developer storage units (moves in a vertical direction to the page in FIG. 2), while being mixed and stirred with the developer by the two carrier screws 55Y. The toner in the developer is attracted to the carrier due to frictional electrification with the carrier, and carried on the developing roller 51Y together with the carrier by a magnetic force generated on the developing roller 51Y.

The developer carried on the developing roller 51Y is carried in the arrow direction in FIG. 2 to reach the position of the doctor blade 52Y. An amount of the developer is optimized at this position, and the developer on the developing roller 51Y is carried to the opposed position to the photosensitive drum 1Y (which is a developing area). The toner is then attracted to the latent image formed on the photosensitive drum 1Y due to an electric field formed in the developing area. The developer remaining on the developing roller 51Y reaches the upper part of the developer storage unit with the rotation of the sleeve and is separated from the developing roller 51Y at this position.

The intermediate transfer-belt device 15 (belt device) characteristic of the image forming apparatus according to the present embodiment is described in detail with reference to FIGS. 3 to 10.

Figure 4:
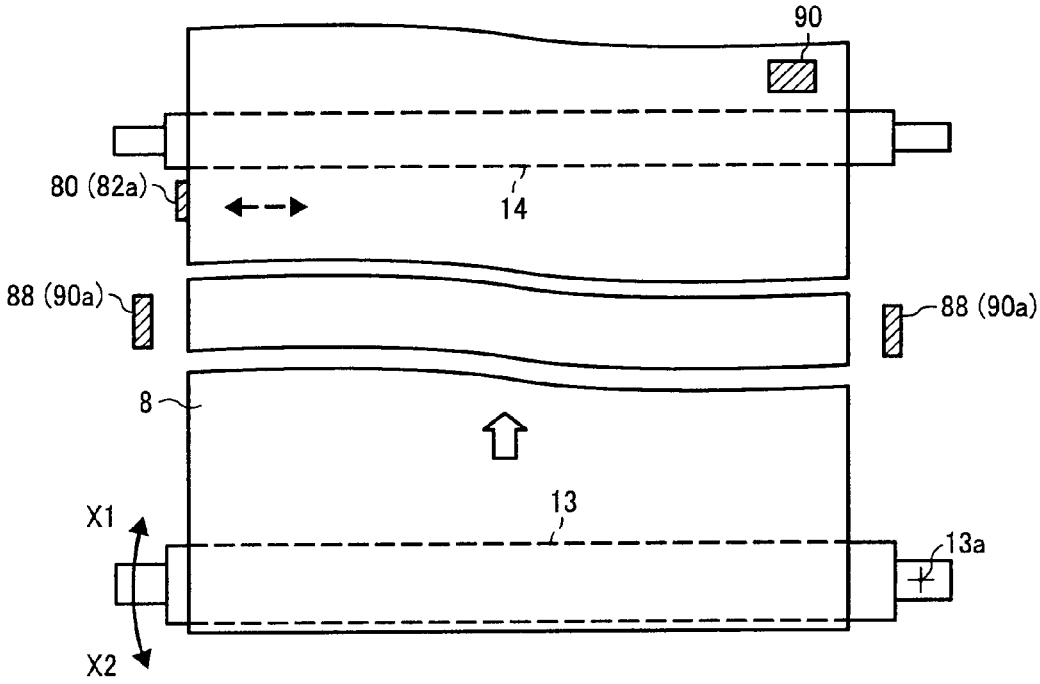
FIG. 4 is a schematic diagram of a part of the belt device as viewed in a width direction.
Figure 5:
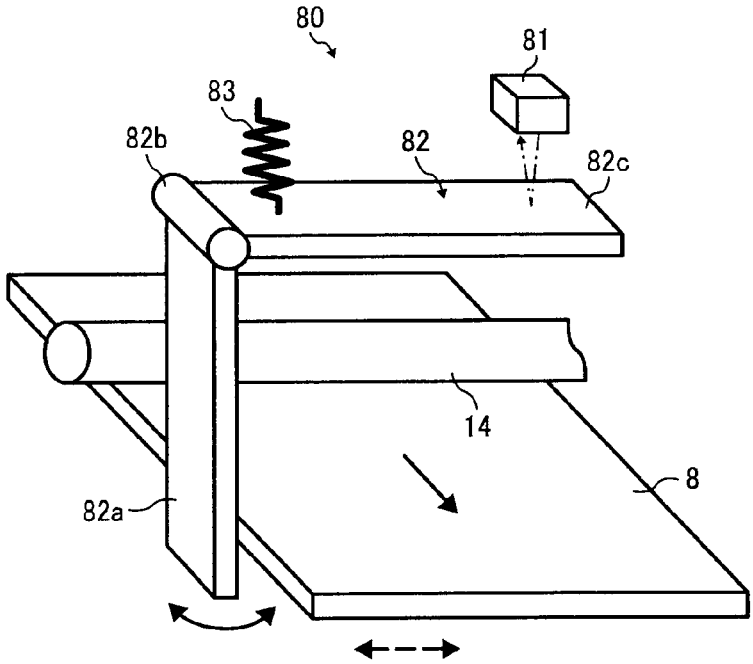
FIG. 5 is a perspective view of a first detector.
Figure 6:
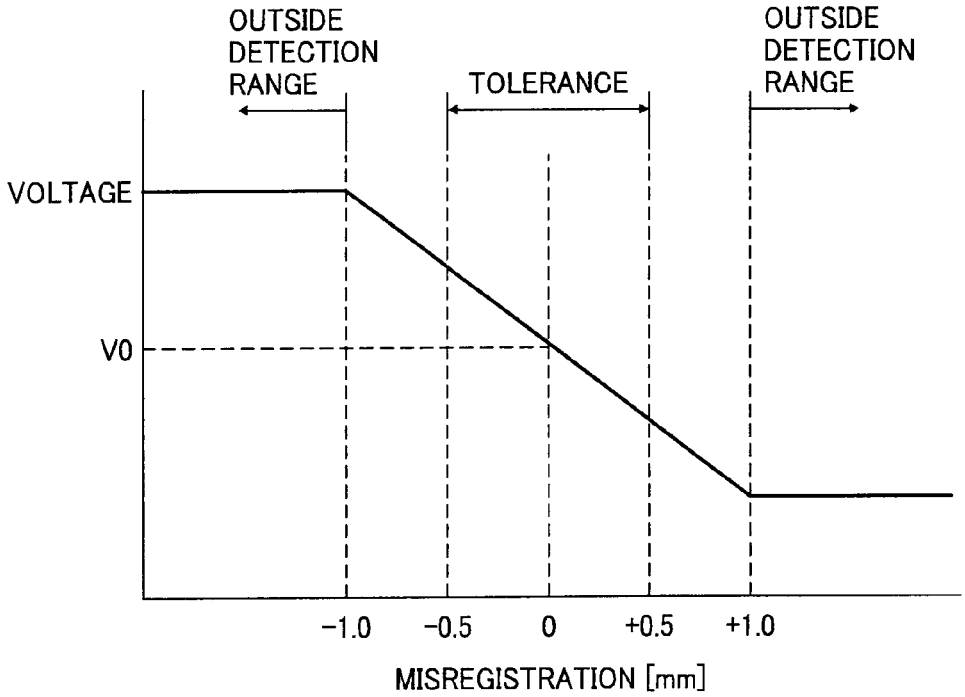
FIG. 6 is a graph of a relation between a misregistration amount of a belt member and an output voltage of the first detector.
Figure 7:
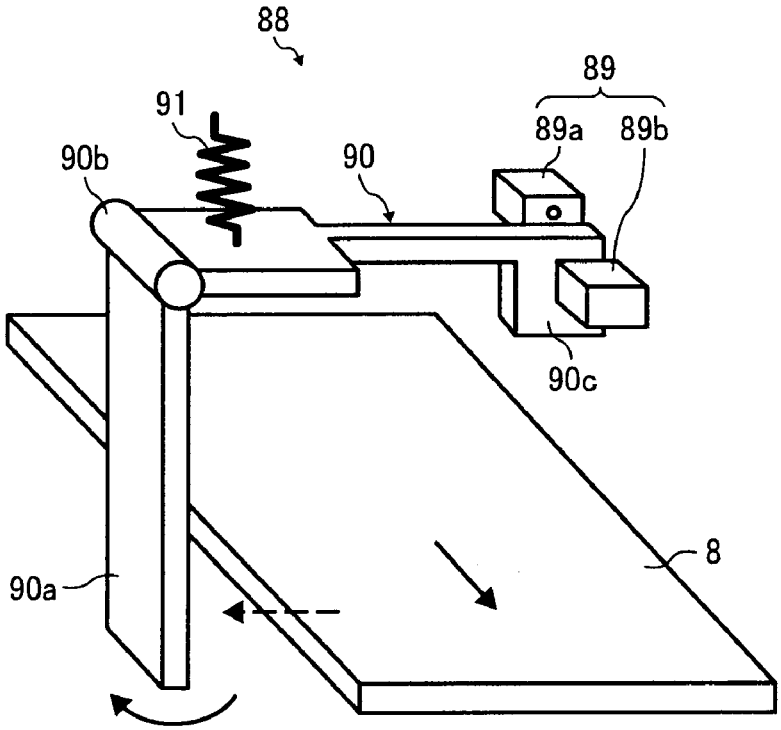
FIG. 7 is a perspective view of a second detector.
Figure 8:
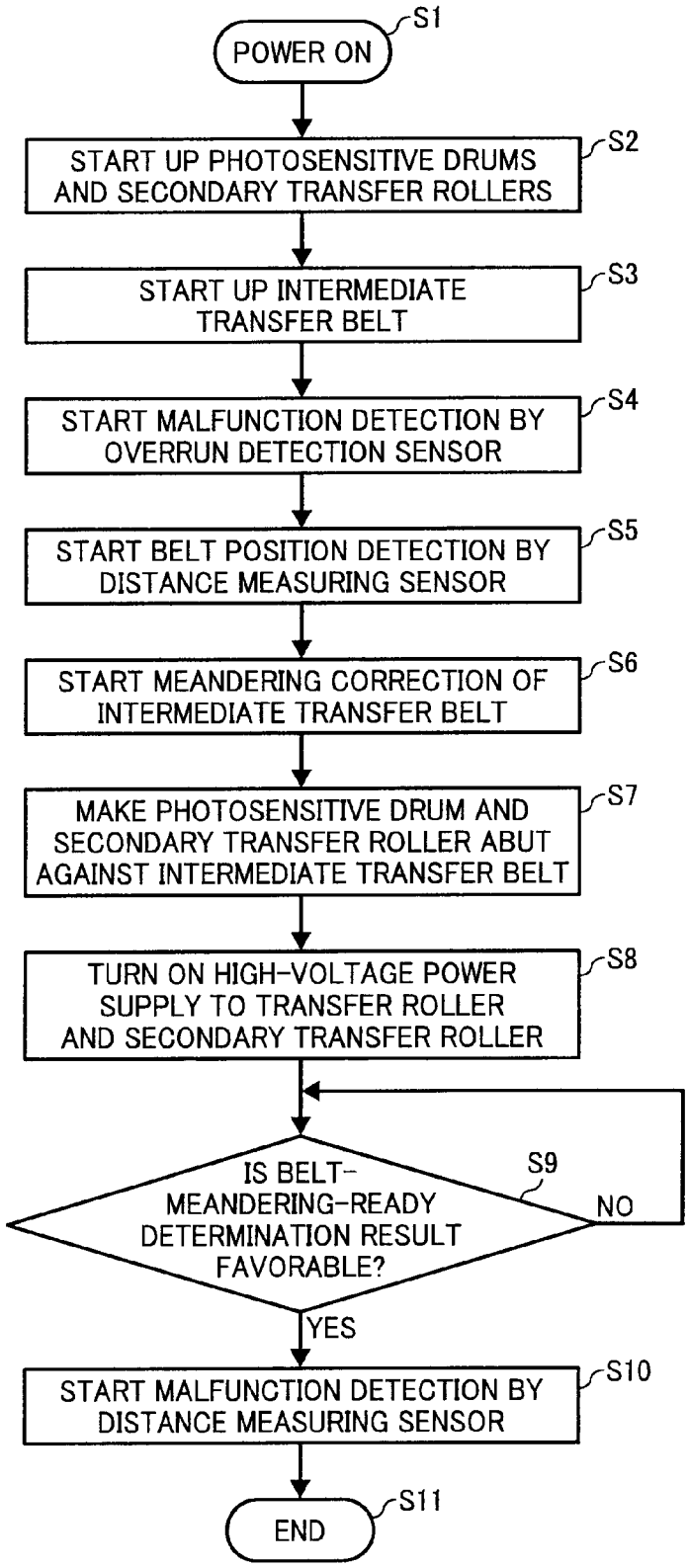
FIG. 8 is a flowchart of a control performed by the belt device.
Figure 9:
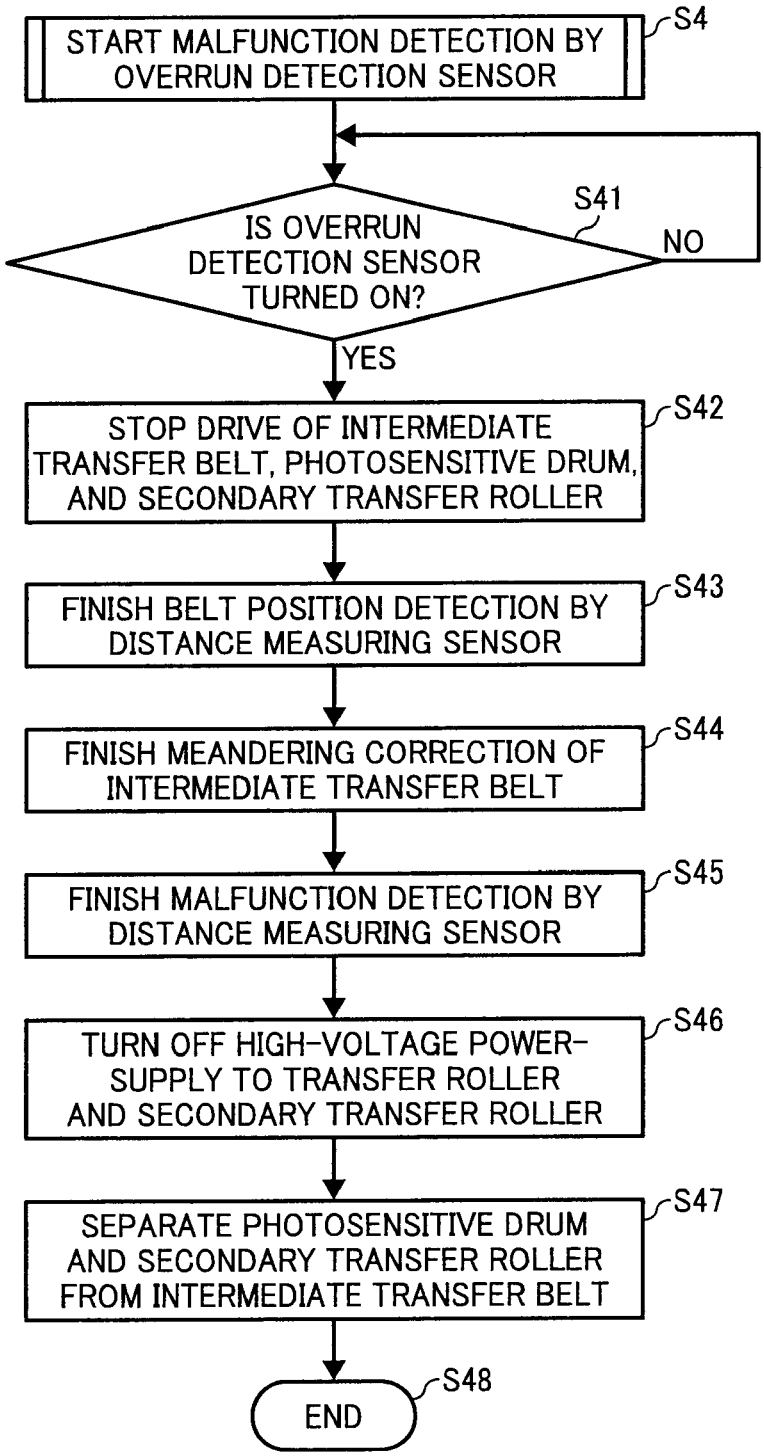
FIG. 9 is a continuation of the flowchart shown in FIG. 8.
Figure 10:
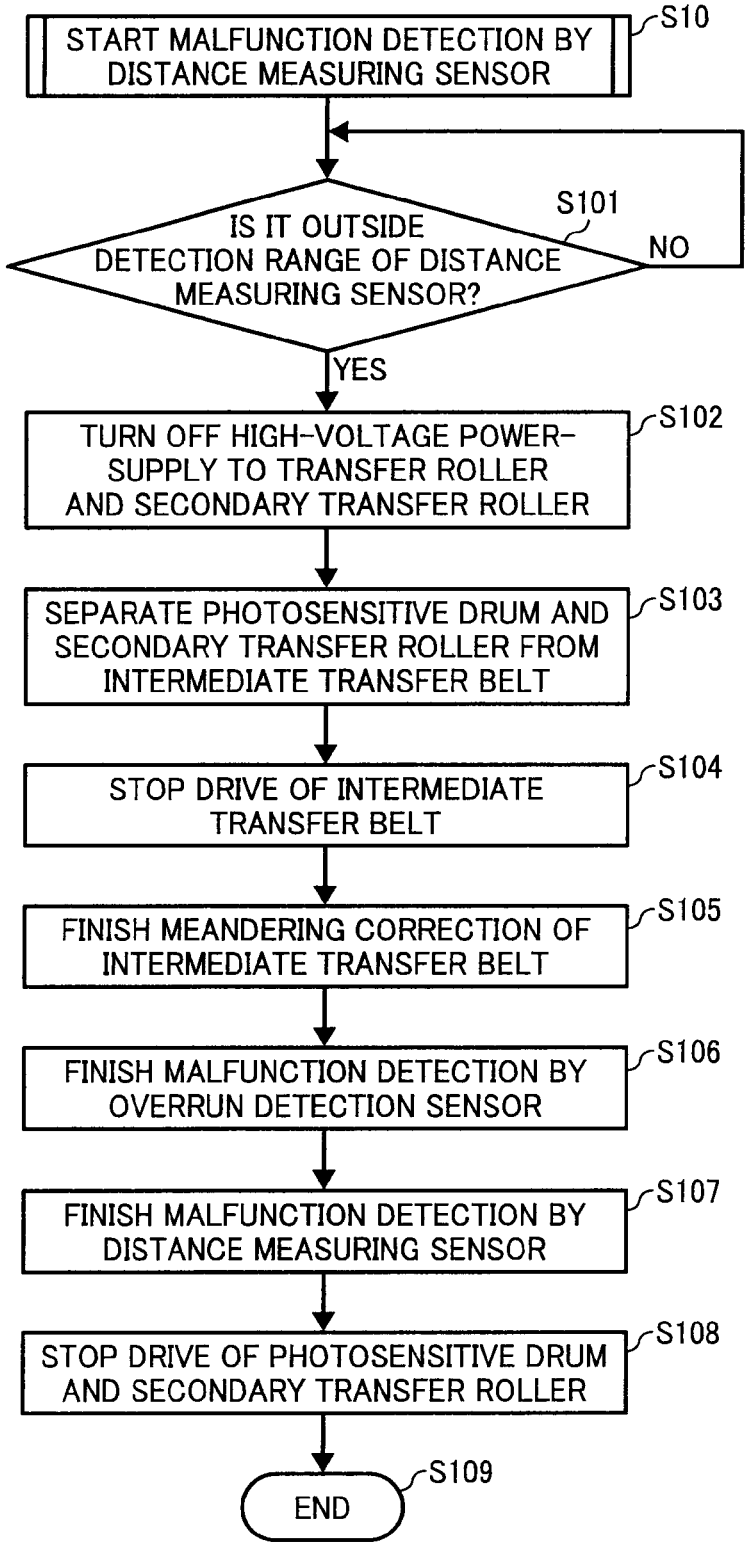
FIG. 10 is a continuation of the flowchart shown in FIG. 9.

FIG. 3 is a block diagram of the intermediate transfer-belt device 15 as the belt device. FIG. 4 is a schematic diagram of a part of the intermediate transfer-belt device 15 as viewed in a width direction. FIG. 5 is a perspective view around the first detector 80 in the intermediate transfer-belt device 15. FIG. 6 is a graph of a relation between a misregistration amount (displacement magnitude) of the intermediate-transfer belt 8 and an output voltage of the first detector 80. FIG. 7 is a perspective view around the second detector 88 in the intermediate transfer-belt device 15. FIGS. 8 to 10 are flowcharts of a control performed by the intermediate transfer-belt device 15 at the time of initialization immediately after turning the power on.

With reference to FIGS. 3 and 4, the intermediate transfer-belt device 15 (belt device) includes the intermediate transfer belt 8 as the belt member, the four transfer rollers 9Y, 9m, 9C, and 9K, the drive roller 12A, the tension rollers 12B and 12C, the correcting roller 13 as the correcting unit, the regulating roller 14, the first detector 80 as the first detecting unit, the second detector 88 as the second detecting unit, the photosensor 90, and the intermediate-transfer cleaning unit 10.

The intermediate transfer belt 8 as the belt member is arranged to face the photosensitive drums 1Y, 1M, 1C, and 1K as the four image carriers that respectively carry the toner image of each color. The intermediate transfer belt 8 is laid across in a tensioned condition and supported mainly by the five roller members (the drive roller 12A, the tension rollers 12B and 12C, the correcting roller 13, and the regulating roller 14).

In the present embodiment, the intermediate transfer belt 8 is formed of polyvinylidene fluoride (PVDF), ethylene-tetrafluoroethylene copolymer (ETFE), polyimide (PI), or polycarbonate (PC) in a single layer or a plurality of layers, in which a conductive material such as carbon black is dispersed. The intermediate transfer belt 8 is adjusted so that volume resistivity is within a range of $10^7$ Ωcm to $12^{12}$ Ωcm, and surface resistivity of a rear side of the belt is within a range of $10^8$ Ωcm to $12^{12}$ Ωcm. The thickness of the intermediate transfer belt 8 is set to a range of from 80 micrometers to 100 micrometers. In the present embodiment, the thickness of the intermediate transfer belt 8 is set to 90 micrometers.

A release layer can be coated on the surface of the intermediate transfer belt 8 as required. At this time, fluorocarbon resin such as ethylene-tetrafluoroethylene copolymer (ETFE), polytetrafluoroethylene (PTFE), polyvinylidene fluoride (PVDF), perfluoro alkoxy fluorine resin (PFA), fluorinated ethylene propylene copolymer (FEP), and polyvinyl fluoride (PVF) can be used as a material to be used for coating; however, the release layer is not limited thereto.

As a manufacturing method of the intermediate transfer belt 8, an injection method, centrifugal casting, and the like can be used, and a surface polishing process of the intermediate transfer belt 8 is performed as required.

The respective transfer rollers 9Y, 9M, 9C, and 9K are opposed to the corresponding photosensitive drums 1Y, 1M, 1C, and 1K via the intermediate transfer belt 8. More specifically, the transfer roller 9Y for yellow is opposed to the photosensitive drum 1Y for yellow via the intermediate transfer belt 8, the transfer roller 9M for magenta is opposed to the photosensitive drum 1M for magenta via the intermediate transfer belt 8, the transfer roller 9C for cyan is opposed to the photosensitive drum 1C for cyan via the intermediate transfer belt 8, and the transfer roller 9K for black is opposed to the photosensitive drum 1K for black via the intermediate transfer belt 8.

The four transfer rollers 9Y, 9M, 9C, and 9K are formed so that the intermediate transfer belt 8 is separated from the photosensitive drums 1Y, 1M, 1C, and 1K.

Specifically, the three color transfer rollers 9Y, 9M, and 9C of the four transfer rollers 9Y, 9M, 9C, and 9K are integrally held by a holding member (not shown), and are formed integrally movably in the vertical direction. The black transfer roller 9K is formed independently movably in the vertical direction. The four transfer rollers 9Y, 9M, 9C, and 9K move to a position as shown by broken line in FIG. 3 to separate the intermediate transfer belt 8 from the photosensitive drums 1Y, 1M, 1C, and 1K (movement to the broken line position). The operation for separating the intermediate transfer belt 8 from the photosensitive drums 1Y, 1M, 1C, and 1K is performed for reducing abrasion deterioration of the intermediate transfer belt 8, and it is mainly performed when the image is not formed. The reason why the black transfer roller 9K is formed independently movably in the vertical direction is that the three color transfer rollers 9Y, 9M, and 9C are moved downward at the time of forming a monochrome image, thereby separating the color photosensitive drums 1Y, 1M, and 1C, from the intermediate transfer belt 8.

The drive roller 12A is rotated by the drive motor (not shown). Accordingly, the intermediate transfer belt 8 is driven in a predetermined traveling direction (clockwise direction in FIG. 3).

One tension roller 12B abuts against the secondary transfer roller 19 via the intermediate transfer belt 8. The other tension roller 12C abuts against an outer circumference of the intermediate transfer belt 8. The intermediate-transfer cleaning unit 10 (cleaning blade) is arranged between the both tension rollers 12B and 12C.

The first detector 80 as the first detecting unit that detects the widthwise displacement magnitude (vertical direction to the page in FIG. 3) of the intermediate-transfer belt 8 is arranged in the intermediate transfer-belt device 15 according to the present embodiment.

Specifically, with reference to FIG. 5, the first detector 80 includes a rocking member 82 that abuts against the end of the intermediate transfer belt 8 in the width direction, a distance measuring sensor 81 that detects the displacement magnitude of the rocking member 82, and a spring 83 energized in such a direction that the rocking member 82 is made to abut against the intermediate transfer belt 8.

The rocking member 82 includes a first arm 82*a*, a rotation spindle 82*b*, and a second arm 82*c*. One end of the first arm 82*a* abuts against the end of the intermediate transfer belt 8 in the width direction, and the other end thereof is set to the rotation spindle 82*b*. The rotation spindle 82*b* is rotatably supported by a housing (not shown) of the intermediate transfer-belt device 15. One end of the second arm 82*c* is set to the rotation spindle 82*b*. One end of the spring 83 is connected to the center of the second arm 82*c*. The other end of the spring 83 is connected to the housing.

With such a configuration, the rocking member 82 rocks (in directions indicated by double-headed arrow with solid line in FIG. 5), following the widthwise displacement of the intermediate transfer belt 8 (belt misalignment in directions indicated by double-headed arrow with broken line in FIG. 5). In the present embodiment, the intermediate transfer belt 8 is set to travel at a speed of 440 mm/sec. in the traveling direction (arrow direction in FIG. 5).

The distance measuring sensor 81 is arranged above the end of the second arm 82*c* of the rocking member 82 (set to the housing). The distance measuring sensor 81 mainly includes a light emitting diode (infrared-emitting diode) and a position sensing device (PSD) arranged in parallel and away from each other in the horizontal direction. Infrared light emitted from the light emitting diode is reflected by the surface of the second arm 82*c*, and enters into the position sensing device as reflected light. At this time, an incident position of the reflected light to be incident to the position sensing device changes according to the distance between the distance measuring sensor 81 and the surface of the second arm 82*c*, thereby changing an output value of a photodetector (the distance measuring sensor 81) in proportion to the change (see FIG. 6). Accordingly, the displacement magnitude of the intermediate transfer belt 8 in the width direction (distance from the surface of the second arm 82*c*) can be detected. Specifically, with reference to FIG. 6, if the output value of the distance measuring sensor 81 is smaller than a predetermined value (voltage V0), the intermediate transfer belt 8 is displaced in a plus direction with respect to a target position (rightward misregistration in FIG. 5), and if the output value of the distance measuring sensor 81 is larger than the predetermined value (voltage V0), the intermediate transfer belt 8 is displaced in a minus direction with respect to the target position (leftward misregistration in FIG. 5).

In the present embodiment, the first detector 80 detects an abnormal belt misalignment (malfunction detection) at the time of normal image formation (at the time of printing).

Specifically, with reference to FIG. 6, the belt misalignment (misregistration) of ±0.5 millimeter with respect to the target position (misregistration: 0 millimeter) is designated as a tolerance (printing tolerance), and belt misregistration is corrected by the correcting roller 13 based on the detection result of the first detector 80. When the belt misalignment (misregistration) of the intermediate transfer belt 8 becomes outside the detection range (±1 millimeter) of the first detector 80, it is determined that a relatively large belt misalignment has occurred, and the apparatus is forcibly stopped, and malfunction detection display is performed on a display unit (not shown) of the apparatus main unit 100.

Separate from the malfunction detection by the first detector 80, malfunction detection by the second detector 88 is also performed. The reason why malfunction detection of the belt misalignment is performed in duplicate is that, even if the first detector 80 is broken down or control software malfunctions, malfunction detection can be performed reliably.

The malfunction detection by the first detector 80 is not performed at the time of initialization after turning the power on. This will be explained later in detail.

The regulating roller 14 that regulates the displacement in a direction different from the width direction and the traveling direction of the intermediate transfer belt 8 is arranged near the first detector 80 (first detecting unit). Specifically, the regulating roller 14 is arranged adjacent to an abutment position between the rocking member 82 (the first arm 82*a*) and the intermediate transfer belt 8 (an upstream side in the traveling direction of the intermediate transfer belt 8 with respect to the abutment position).

Due to such a configuration, displacement (deflection) in a direction orthogonal to the width direction of the intermediate transfer belt 8 (vertical direction to the page in FIG. 4) can be reduced in the first detector 80 (at the abutment position between the rocking member 82 and the intermediate transfer belt 8). That is, because belt tension of the intermediate transfer belt 8 is increased by the regulating roller 14, the displacement of the position of the first detector 80 in the orthogonal direction is regulated. Accordingly, such a problem that a displacement component in a direction different from the width direction and the traveling direction is also detected other than a detection component (detection component in the width direction) to be originally detected can be reduced. That is, detection accuracy by the first detector 80 with respect to the belt misalignment of the intermediate transfer belt 8 can be improved.

When the first detector 80 detects the displacement (displacement magnitude) of the intermediate transfer belt 8, the widthwise displacement of the intermediate transfer belt 8 is corrected by the correcting roller 13 as the correcting unit based on the detection result.

With reference to FIG. 3, the correcting roller 13 is set to come in contact with an inner circumference of the intermediate transfer belt 8 on the upstream side of the intermediate transfer belt 8 in the traveling direction with respect to the photosensitive drums 1Y, 1M, 1C, and 1K. With reference to FIG. 4, the correcting roller 13 rocks in X1 and X2 directions, centering on a rocking center 13*a*, because a drive cam (not shown) is operated for a predetermined angle.

According to such a configuration, in FIG. 4, when the intermediate transfer belt 8 is displaced (belt misalignment) rightward, the correcting roller 13 rocks in X2 direction to perform a displacement correction of the intermediate transfer belt 8 based on the detection result. On the other hand, when the intermediate transfer belt 8 is displaced leftward, the correcting roller 13 rocks in X1 direction to perform the displacement correction of the intermediate transfer belt 8 based on the detection result. Accordingly, such problems can be prevented that the quality of a color image is degraded due to meandering of the intermediate transfer belt 8, and that the intermediate transfer belt 8 is largely displaced widthwise (belt misalignment) to come in contact with another member, and the intermediate transfer belt 8 is broken.

With reference to FIG. 4, in the intermediate transfer-belt device 15 according to the present embodiment, the second detector 88 as the second detecting unit is respectively arranged at positions predetermined distance away from the opposite ends of the intermediate transfer belt 8 in the width direction.

As shown in FIG. 7, the second detector 88 includes an arm member 90' that comes in contact with the intermediate transfer belt 8 having large belt misalignment, an overrun detection sensor 89 (optical sensor) that optically detects the movement of the arm member, centering on a rotation spindle 90*b*, due to contact with the intermediate transfer belt 8, and a spring 91 for maintaining a posture of the arm member 90'.

Specifically, with reference to FIG. 7, the arm member 90' includes a first arm 90*a*, the rotation spindle 90*b*, and a second arm 90*c*. One end of the first arm 90*a* is arranged at a position 5 millimeters away from a widthwise end of the intermediate transfer belt 8, which is at a normal position, and the other end thereof is set to the rotation spindle 90*b*. The rotation spindle 90*b* is rotatably supported by a housing (not shown) of the intermediate transfer-belt device 15. One end of the second arm 90*c* is set to the rotation spindle 90*b*, and the other end thereof is arranged between a light emitting unit 89*a* and a photodetector 89*b* of the overrun detection sensor 89. One end of the spring 91 is connected to the center of the second arm 90*c*. The other end of the spring 91 is connected to the housing. Although not shown, a part of the second arm 90*c* abuts against a positioning unit of the housing due to an energizing force of the spring 91.

Due to such a configuration, the arm member 90' abuts against the intermediate transfer belt 8 and rocks (in a direction indicated by solid arrow in FIG. 7), when a large belt misalignment exceeding 5 millimeters occurs in the intermediate transfer belt 8.

This state is detected by the overrun detection sensor 89. That is, because the light emitted from the light emitting unit 89*a* is received by the photodetector 89*b*, the state of the end of the second arm 90*c* separated from between the light emitting unit 89*a* and the photodetector 89*b* is recognized.

When malfunction detection is performed by the second detector 88 (the overrun detection sensor 89) in this manner, the drive of the intermediate transfer belt 8 (drive roller 12A), and the drive of the photosensitive drums 1Y, 1M, 1C, and 1K and the secondary transfer roller 19 are forcibly stopped, and a separation operation of the intermediate transfer belt 8 relative to the photosensitive drums 1Y, 1M, 1C, and 1K and the secondary transfer roller 19 is forcibly performed, and a display of maintenance person call (display indicating that repair by the maintenance person is required) is performed on the display unit of the apparatus main unit 100.

In the present embodiment, with reference to FIG. 3, the secondary transfer roller 19 moves (movement in arrow direction) such that it can be freely brought into contact with or separated from the intermediate transfer belt 8.

With reference to FIGS. 3 and 4, the intermediate transfer-belt device 15 according to the present embodiment includes the photosensor 90 installed therein. The photosensor 90 is for detecting the position and density of a toner image (patch pattern) carried on the intermediate transfer belt 8, and for optimizing imaging conditions. Specifically, the photosensor 90 optically detects a misregistration of respective color toner images (patch patterns) formed on the intermediate transfer belt 8 through the imaging process described above, to adjust exposure timing by the exposure unit 7 onto the respective photosensitive drums 1Y, 1M, 1C, and 1K. Further, the photosensor 90 optically detects the density (toner density) of the toner image (patch pattern) formed on the intermediate transfer belt 8 through the imaging process, to adjust the toner density of the developer stored in the developing unit 5 based on the detection result.

With reference to FIGS. 8 to 10, characteristic control performed by the intermediate transfer-belt device 15 is explained in detail.

With reference to FIG. 8, when a power source of the apparatus main unit 100 is turned on (main switch ON) (step S1), drive of the photosensitive drums 1Y, 1M, 1C, and 1K and the secondary transfer roller 19 as rotation members is started (step S2). Drive of the intermediate transfer belt 8 is also started (step S3).

Malfunction detection with respect to the belt position of the intermediate transfer belt 8 by the overrun detection sensor 89 (the second detector 88) is started (step S4). A control flow of malfunction detection by the overrun detection sensor 89 will be explained later in detail with reference to FIG. 9.

Subsequently, detection of meandering of the intermediate transfer belt 8 (belt position detection) by the distance measuring sensor 81 (the first detector 80) is started (step S5). Based on a detection result thereof, meandering correction of the intermediate transfer belt 8 is started (step S6). Specifically, an angle of inclination of the correcting roller 13 is adjusted and controlled.

Thereafter, the photosensitive drums 1Y, 1M, 1C, and 1K and the secondary transfer roller 19 as abutment members are made to abut against the intermediate transfer belt 8 (step S7). Specifically, the transfer rollers 9Y, 9M, 9C, and 9K move upward so that the intermediate transfer belt 8 abuts against the photosensitive drums 1Y, 1M, 1C, and 1K, and the secondary transfer roller 19 also moves upward to abut against the intermediate transfer belt 8 (in the state of FIG. 3).

High voltage is supplied to the transfer rollers 9Y, 9M, 9C, and 9K (primary transfer rollers) and the secondary transfer roller 19 as members arranged around the intermediate transfer belt 8 (step S8).

Subsequently, belt-meandering-ready determination is performed (step S9). Unless the determination result is NO, malfunction detection by the distance measuring sensor 81 (the first detector 80) with respect to the belt position of the intermediate transfer belt 8 is started (step S10), to finish the flow (step S11). However, thereafter, control can be performed such that the position and the density of the toner image carried on the intermediate transfer belt 8 are detected to optimize the imaging conditions.

Determination of "belt-meandering-ready determination" at step S9 is performed for confirming whether drive preparation of the intermediate transfer belt 8 is completed, and determination is performed according to two conditions: (1) meandering speed of the intermediate transfer belt 8 is within ±19.5 μm/sec, and (2) running position (widthwise position) of the intermediate transfer belt 8 is within ±0.5 millimeter are satisfied continuously for 15 seconds. Further, belt-meandering-ready determination is performed only at the time of initialization, and is not performed after printing has been started.

The control flow of malfunction detection by the distance measuring sensor 81 at step S10 will be explained later in detail with reference to FIG. 10.

With reference to FIG. 9, malfunction detection by the overrun detection sensor 89 (the second detector 88) (step S4 in FIG. 8) is explained in detail.

First, it is determined whether the overrun detection sensor 89 is turned on (step S41). When the overrun detection sensor 89 is turned on, it is determined that belt misalignment of the intermediate transfer belt 8 exceeding the predetermined distance (5 millimeters) has occurred, the drive of the intermediate transfer belt 8 is stopped, and the drive of the photosensitive drums 1Y, 1M, 1C, and 1K and the secondary transfer roller 19 as the rotation members are stopped (step S42). Specifically, motor clocks of a stepping motor that drives the intermediate transfer belt 8 (drive roller 12A) and a stepping motor that drives the photosensitive drums 1Y, 1M, 1C, and 1K are forcibly stopped, and thereafter, excitation of each motor is turned off. Power supply to a DC motor that drives the secondary transfer roller 19 is forcibly stopped as well.

Further, belt position detection by the distance measuring sensor 81 (the first detector 80) is concluded (step S43), and meandering correction of the intermediate transfer belt 8 is concluded (step S44). Malfunction detection by the distance measuring sensor 81 (the first detector 80) is also concluded (step S45). Application of voltage from a high-voltage power supply to the transfer rollers 9Y, 9M, 9C, and 9K (primary transfer rollers) and the secondary transfer roller 19 is cut off (stopped) (step S46).

The photosensitive drums 1Y, 1M, 1C, and 1K and the secondary transfer roller 19 as the abutment members are relatively separated from the intermediate transfer belt 8 (step S47). Specifically, the transfer rollers 9Y, 9M, 9C, and 9K move downward to separate the intermediate transfer belt 8 from the photosensitive drums 1Y, 1M, 1C, and 1K, and the secondary transfer roller 19 moves downward and is separated from the intermediate transfer belt 8, to finish the flow (step S48).

With reference to FIG. 10, malfunction detection (step S10 in FIG. 8) by the distance measuring sensor 81 (the first detector 80) is explained in detail.

It is first determined whether the belt position of the intermediate transfer belt 8 is within the detection range of the distance measuring sensor 81 (step S101). In the present embodiment, the detection range of the distance measuring sensor 81 is set within ±1 millimeter with respect to the target position.

When the belt position of the intermediate transfer belt 8 is outside the detection range of the distance measuring sensor 81, it is determined that belt misalignment exceeding the detection range of the first detector has occurred in the intermediate transfer belt, and application of voltage from the high-voltage power supply to the transfer rollers 9Y, 9M, 9C, and 9K and the secondary transfer roller 19 is cut off (stopped) (step S102).

Further, the photosensitive drums 1Y, 1M, 1C, and 1K and the secondary transfer roller 19 as the abutment members are relatively separated from the intermediate transfer belt 8 (step S103). The drive of the intermediate transfer belt 8 is stopped (step S104), and meandering correction of the intermediate transfer belt 8 is concluded (step S105).

Malfunction detection by the overrun detection sensor 89 (the second detector 88) is concluded (step S106), and malfunction detection by the distance measuring sensor 81 (the first detector 80) is also concluded (step S107).

The drive of the photosensitive drums 1Y, 1M, 1C, and 1K and the secondary transfer roller 19 as the rotation members are stopped (step S108), to finish the flow (step S109).

The control flow of malfunction detection by the distance measuring sensor 81 (the first detector 80) shown in FIG. 10 is also performed at the time of printing (at the time of image formation).

As explained above, in the present embodiment, widthwise displacement of the intermediate transfer belt 8 is corrected by the correcting roller 13 based on the detection result of the first detector 80, during a predetermined period of time that elapses since turning the power of the apparatus main unit 100 (main switch ON) on (at the time of initialization, and until the drive preparation of the intermediate transfer belt 8 is completed). When the second detector 88 detects a displacement of the intermediate transfer belt 8 exceeding the predetermined distance (5 millimeters), the drive (traveling) of the intermediate transfer belt 8 is stopped. That is, malfunction detection by the first detector 80 is not performed at the time of initialization until completion of the drive preparation of the intermediate transfer belt 8 is confirmed (initial stage of initialization), and only malfunction detection by the second detector 88 is performed.

Accordingly, when the intermediate transfer belt 8 is replaced due to maintenance or the like, even if the replaced intermediate transfer belt 8 is assembled by an operator, deviated widthwise from the target position, if there is essentially no malfunction in the intermediate transfer-belt device 15 (or the image forming apparatus 100), the intermediate transfer belt 8 is reliably corrected to the target position by the correcting roller 12 (correcting unit) at the time of initialization after turning the power on. On the other hand, when there is essentially malfunction in the intermediate transfer-belt device 15 (or the image forming apparatus 100), the malfunction is reliably detected by the second detector 88 to forcibly stop the operation of the image forming apparatus 100. Accordingly, such a problem that the relatively expensive intermediate transfer belt 8 just replaced is damaged can be reliably prevented.

In the present embodiment, when malfunction is detected by the second detector 88 at the initial stage of initialization, rotation of the photosensitive drums 1Y, 1M, 1C, and 1K and the secondary transfer roller 19 (the rotation members that abut against the intermediate transfer belt 8) are stopped. Accordingly, such a problem that the intermediate transfer belt 8, drive of which is forcibly stopped, is damaged due to sliding with the photosensitive drums 1Y, 1M, 1C, and 1K and the secondary transfer roller 19 can be suppressed. At the same time, the photosensitive drums 1Y, 1M, 1C, and 1K and the secondary transfer roller 19 can be prevented from being damaged due to sliding with the intermediate transfer belt 8. The control is also performed when the second detector 88 detects malfunction after completion of the drive preparation of the intermediate transfer belt 8 has been confirmed or at the time of printing. Also in this case, the intermediate transfer belt 8, the photosensitive drums 1Y, 1M, 1C, and 1K, and the secondary transfer roller 19 can be prevented from being damaged.

In the present embodiment, when the second detector 88 detects malfunction at the initial stage of initialization, the intermediate transfer belt 8 is controlled so that the intermediate transfer belt 8 is relatively separated from the photosensitive drums 1Y, 1M, 1C, and 1K, and the secondary transfer roller 19 (abutment members that abut against the intermediate transfer belt 8). Accordingly, the intermediate transfer belt 8 just replaced can be prevented from being damaged due to sliding with the photosensitive drums 1Y, 1M, 1C, and 1K and the secondary transfer roller 19. At the same time, the photosensitive drums 1Y, 1M, 1C, and 1K and the secondary transfer roller 19 can be prevented from being damaged due to sliding with the intermediate transfer belt 8. Particularly, after the second detector 88 detects malfunction, maintenance including detachment of the intermediate transfer belt 8 is performed. Therefore, by retreating the photosensitive drums 1Y, 1M, 1C, and 1K and the secondary transfer roller 19 from the intermediate transfer belt 8, maintainability can be improved. The control is also performed when the second detector 88 detects malfunction after completion of the drive preparation of the intermediate transfer belt 8 has been confirmed or at the time of printing. Also in this case, the intermediate transfer belt 8, the photosensitive drums 1Y, 1M, 1C, and 1K, and the secondary transfer roller 19 can be prevented from being damaged.

In the present embodiment, when the second detector 88 detects malfunction at the initial stage of initialization, application of voltage to the transfer rollers 9Y, 9M, 9C, and 9K and the secondary transfer roller 19 (members arranged around the intermediate transfer belt 8) is cut off. Accordingly, a problem such that high voltage is locally applied to the intermediate transfer belt 8 and the drive of which has been forcibly stopped to damage the intermediate transfer belt 8 is suppressed. At the same time, a problem such that high voltage is locally applied to the photosensitive drums 1Y, 1M, 1C, and 1K, and the secondary transfer roller 19, thereby causing a damage therein is also suppressed. When the voltage is applied directly to the intermediate transfer belt 8, it is desired to cut off the voltage upon detection of malfunction by the second detector 88. The control is also performed when the second detector 88 detects malfunction after completion of the drive preparation of the intermediate transfer belt 8 has been confirmed or at the time of printing. Also in this case, the intermediate transfer belt 8, the photosensitive drums 1Y, 1M, 1C, and 1K, and the secondary transfer roller 19 can be prevented from being damaged.

Further, in the present embodiment, widthwise displacement of the intermediate transfer belt 8 is corrected by the correcting roller 13 based on the detection result of the first detector 80, after completion of the drive preparation of the intermediate transfer belt 8 has been confirmed or after the image forming operation (printing operation) has been started. When the intermediate transfer belt 8 is displaced exceeding the detection range of the first detector 80, the drive of the intermediate transfer belt 8 is stopped, and when the second detector 88 detects the displacement of the intermediate transfer belt 8 exceeding the predetermined range, the drive of the intermediate transfer belt 8 is also stopped. That is, after completion of the drive preparation of the intermediate transfer belt 8 has been confirmed or at the time of normal printing, malfunction detection by the second detector 88 is performed as well as malfunction detection by the first detector 80 (two-stage malfunction detection is performed).

Accordingly, a large belt misalignment of the intermediate transfer belt 8 can be reliably detected (malfunction detection), even if the first detector 80 is broken down or the control software malfunctions.

In the present embodiment, when the first detector 80 detects malfunction after completion of the drive preparation of the intermediate transfer belt 8 has been confirmed or at the time of printing, rotation of the photosensitive drums 1Y, 1M, 1C, and 1K, and the secondary transfer roller 19 is stopped. Further, when the first detector 80 detects malfunction after completion of the drive preparation of the intermediate transfer belt 8 has been confirmed or at the time of printing, the intermediate transfer belt 8 is controlled to be relatively separated from the photosensitive drums 1Y, 1M, 1C, and 1K, and the secondary transfer roller 19. Further, when the first detector 80 detects malfunction after completion of the drive preparation of the intermediate transfer belt 8 has been confirmed or at the time of printing, application of the voltage to the photosensitive drums 1Y, 1M, 1C, and 1K, and the secondary transfer roller 19 is cut off. Accordingly, the intermediate transfer belt 8, the photosensitive drums 1Y, 1M, 1C, and 1K, and the secondary transfer roller 19 can be prevented from being damaged.

As explained above, in the present embodiment, meandering of the intermediate transfer belt 8 (belt member) is corrected based on the detection result of the first detector 80 (first detecting unit), during a period since turning the power of the apparatus on until the drive preparation of the intermediate transfer belt 8 is completed, and the drive of the intermediate transfer belt 8 is forcibly stopped only when large meandering of the intermediate transfer belt 8 is detected by the second detector 88 (second detecting unit), without performing malfunction detection by the first detector 80. Accordingly, even in a case that the intermediate transfer belt 8 has been replaced, meandering and damage of the intermediate transfer belt 8 can be suppressed reliably and efficiently, without uselessly shutting down the image forming apparatus or performing a useless maintenance operation.

In the present embodiment, the present invention is applied to the belt device (intermediate transfer-belt device 15) using the intermediate transfer belt 8 as the belt member. On the other hand, the present invention is also applicable to a belt device using the transfer carrier belt as the belt member (a belt device that transfers a plurality of color toner images on the recording medium, while carrying the recording medium on the belt member). Further, the present invention can be also applied to a belt device using the photosensitive belt (which functions in the same manner as the photosensitive drum of the present embodiment, and is a photoconductor in an endless belt shape) as the belt member. Also in these cases, the first detecting unit and the second detecting unit are installed to perform the same control at the initial stage of initialization, thereby enabling to obtain the same effect as that of the embodiment.

In the present invention, meandering of the belt member is corrected based on the detection result of the first detecting unit, during a period since turning the power of the apparatus on until the drive preparation of the belt member is completed, and the drive of the belt member is forcibly stopped only when large meandering of the belt member is detected by the second detecting unit, without performing malfunction detection by the first detecting unit. Accordingly, even in a case that the belt member has been replaced, meandering and damage of the belt member can be suppressed reliably and efficiently, without uselessly shutting down the image forming apparatus or performing a useless maintenance operation.

It will be readily understood that the present invention is not limited to the above embodiment, and other than the modifications suggested therein, the embodiment can be appropriately modified within the scope of the present invention. In addition, the numbers, positions, and shapes of the constituent elements are not limited to those mentioned in the above embodiment, and they can be changed as appropriate to carry out the present invention.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A belt device for use in an image forming apparatus, the belt device comprising:

an endless belt member that runs in a predetermined direction;

a first detecting unit that detects a widthwise displacement of the belt member indicative of an amount of displacement in a width direction of the belt member;

a correcting unit that corrects displacement of the belt member in the width direction during a period starting from turning power on and ending with completion of drive preparation of the belt member, based on the widthwise displacement detected by the first detecting unit;

a second detecting unit that includes an arm member positioned outside from a widthwise end of the belt member and apart from the widthwise end at a normal position by a threshold, and that detects whether the belt member has displaced in the width direction from the normal position by an amount that is greater than the threshold; and a belt stopping unit that, during the period starting from turning power on and ending with completion of drive preparation of the belt member, stops running of the belt member only when the second detecting unit detects that the belt member has displaced by an amount that is greater than the threshold.

2. The belt device according to claim 1, wherein the correcting unit corrects displacement of the belt member in the width direction after completion of drive preparation of the belt member based on the widthwise displacement detected by the first detecting unit, and the belt stopping unit stops running of the belt member when the second detecting unit detects that the belt member has displaced by an amount that is greater than the threshold, and when the belt member is displaced by an amount that exceeds a detection range of the first detecting unit.

3. The belt device according to claim 1, wherein the correcting unit corrects displacement of the belt member in the width direction after an image forming operation has been started based on the widthwise displacement detected by the first detecting unit, and the belt stopping unit stops running of the belt member when the second detecting unit detects that the belt member has displaced by an amount that is greater than the threshold, and when the belt member is displaced by an amount that exceeds a detection range of the first detecting unit.

4. The belt device according to claim 2, wherein when the belt member is displaced by an amount exceeding the detection range of the first detecting unit, drive of at least one rotation member that abuts against a surface of the belt member is stopped.

5. The belt device according to claim 3, wherein when the belt member is displaced by an amount exceeding the detection range of the first detecting unit, drive of at least one rotation member that abuts against a surface of the belt member is stopped.

6. The belt device according to claim 2, wherein when the belt member is displaced by an amount exceeding the detection range of the first detecting unit, at least one rotation member that abuts against a surface of the belt member is separated from the belt member.

7. The belt device according to claim 3, wherein when the belt member is displaced by an amount exceeding the detection range of the first detecting unit, at least one rotation member that abuts against a surface of the belt member is separated from the belt member.

8. The belt device according to claim 2, wherein when the belt member is displaced by an amount exceeding the detection range of the first detecting unit, application of voltage to the belt member or to at least one rotation member arranged therearound is cut off.

9. The belt device according to claim 3, wherein when the belt member is displaced by an amount exceeding the detection range of the first detecting unit, application of voltage to the belt member or to at least one rotation member arranged therearound is cut off.

10. The belt device according to claim 1, wherein when the second detecting unit detects that the belt member has displaced by an amount that is greater than the threshold, drive of at least one rotation member that abuts against a surface of the belt member is stopped.

11. The belt device according to claim 1, wherein when the second detecting unit detects that the belt member has displaced by an amount that is greater than the threshold, at least one rotation member that abuts against a surface of the belt member is separated from the belt member.

12. The belt device according to claim 1, wherein when the second detecting unit detects that the belt member has displaced by an amount that is greater than the threshold, application of voltage to the belt member or to at least one rotation member arranged therearound is cut off.

13. The belt device according to claim 1, wherein the threshold is larger than a detection range of the first detecting unit.

14. The belt device according to claim 1, wherein the belt member is an intermediate transfer belt, onto which a toner image respectively carried on a plurality of image carriers is transferred.

15. An image forming apparatus comprising:

a belt device for use in the image forming apparatus, the belt device including an endless belt member that runs in a predetermined direction;

a first detecting unit that detects a widthwise displacement of the belt member indicative of an amount of displacement in a width direction of the belt member;

a correcting unit that corrects displacement of the belt member in the width direction during a period starting from turning power on and ending with completion of drive preparation of the belt member, based on the widthwise displacement detected by the first detecting unit;

a second detecting unit that includes an arm member positioned outside from a widthwise end of the belt member and apart from the widthwise end at a normal position by a threshold, and that detects whether the belt member has displaced in the width direction from the normal position by an amount that is greater than a threshold; and a belt stopping unit that, during the period starting from turning power on and ending with completion of drive preparation of the belt member, stops running of the belt member only when the second detecting unit detects that the belt member has displaced by an amount that is greater than the threshold.

16. The belt device according to claim 4, wherein the at least one rotation member is at least one of a photosensitive drum and a secondary transfer roller.

17. The belt device according to claim 5, wherein the at least one rotation member is at least one of a photosensitive drum and a secondary transfer roller.

18. The belt device according to claim 1, wherein drive preparation of the belt member is completed when a meandering speed of the intermediate transfer belt is within a tolerance speed and a running position of the belt member is within a tolerance position, and both conditions are satisfied continuously for a predetermined time.

19. A belt device for use in an image forming apparatus, the belt device comprising:

an endless belt member that runs in a predetermined direction;

a first detecting unit that includes a first detection sensor and a rocking member abutting against a widthwise end of the belt member, and that detects a widthwise displacement of the belt member indicative of an amount of displacement in a width direction of the belt member;

a correcting unit that corrects displacement of the belt member in the width direction during a period starting from turning power on and ending with completion of drive preparation of the belt member, based on the widthwise displacement detected by the first detecting unit;

a second detecting unit that includes a second detection sensor and an arm member positioned outside from a widthwise end of the belt member and apart from the widthwise end at a normal position by a threshold, and that detects whether the belt member has displaced in the width direction from the normal position by an amount that is greater than the threshold, the second detecting unit being separated from the first detecting unit; and a belt stopping unit that, during the period starting from turning power on and ending with completion of drive preparation of the belt member, stops running of the belt member only when the second detecting unit detects that the belt member has displaced by an amount that is greater than the threshold.

* * * * *